US006860991B1

(12) United States Patent
Hagon

(10) Patent No.: US 6,860,991 B1
(45) Date of Patent: Mar. 1, 2005

(54) DRAIN TRAP CLEAN-OUT SYSTEM

(76) Inventor: Daniel D. Hagon, 8833 Balfour Rd., Tampa, FL (US) 33635

( * ) Notice: Subject to any disclaimer, the term of this patent is extended or adjusted under 35 U.S.C. 154(b) by 0 days.

(21) Appl. No.: 10/897,791

(22) Filed: Jul. 23, 2004

(51) Int. Cl.[7] ..... B01D 36/00

(52) U.S. Cl. ..... 210/163; 210/311; 210/312; 210/533; 4/679

(58) Field of Search ..... 210/163, 164, 210/311, 312, 313, 532.1, 533, 534; 4/679

(56) References Cited

U.S. PATENT DOCUMENTS 1,641,938 A * 9/1927 Traut ..... 210/312
1,681,117 A * 8/1928 Howcott ..... 210/164
2,263,259 A * 11/1941 Boosey ..... 210/164
2,472,322 A * 6/1949 Weissman ..... 210/532.1
4,250,037 A * 2/1981 Kempa ..... 210/311
4,263,138 A * 4/1981 Kessel ..... 210/163
5,916,436 A * 6/1999 Devore et al. ..... 210/163
6,093,314 A * 7/2000 Wilson et al. ..... 210/164
6,319,397 B1 * 11/2001 Su et al. ..... 4/679

* cited by examiner

*Primary Examiner*—Christopher Upton
(74) *Attorney, Agent, or Firm*—Edward P. Dutkiewicz

(57) ABSTRACT

An interior pipe has an upper end, a lower end and a central extent. An exterior pipe has an upper region receiving the central extent of the interior pipe and a lower region receiving the lower extent of the interior pipe. The lower region terminates with a removably coupled plug. A T-shaped pipe has an upper, lower and central portions. The upper portion is coupled with respect to the interior pipe. The lower portion is coupled with respect to the exterior pipe. The central portion is adapted to be joined to a wastewater line. Water passing from the sink will flow downwardly through the interior pipe and upwardly through the space between the interior and exterior pipes passing through one or more screens, then laterally through the central portion of the T-shaped pipe.

7 Claims, 3 Drawing Sheets

FIG 1
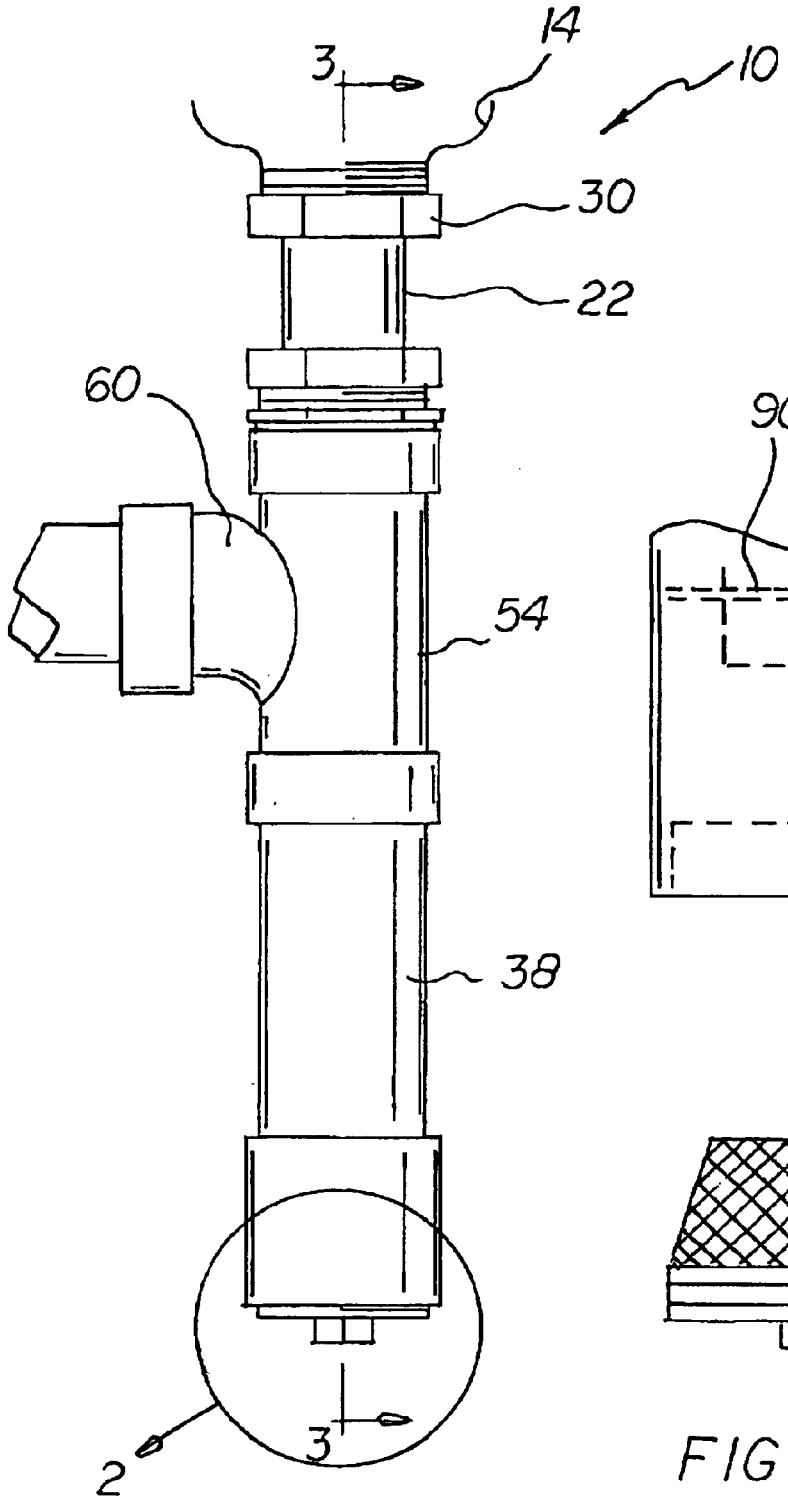
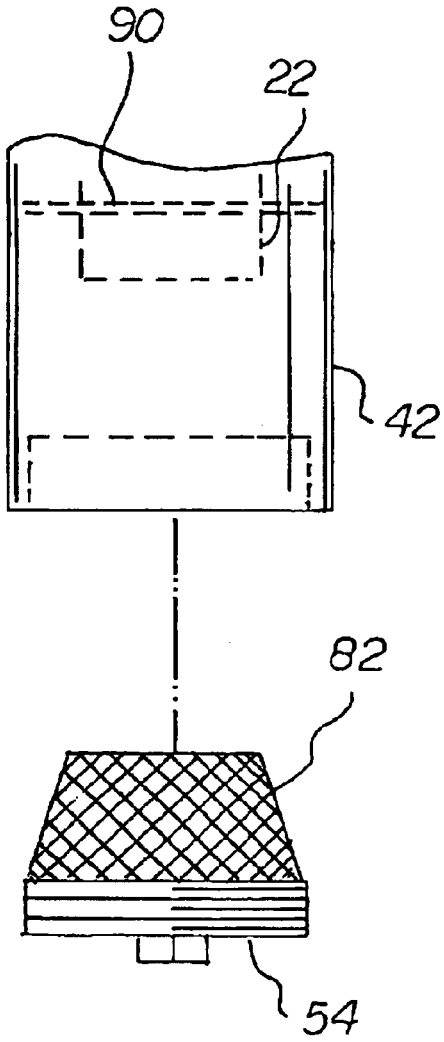
FIG 2

DRAIN TRAP CLEAN-OUT SYSTEM

BACKGROUND OF THE INVENTION

1. Field of the Invention

The present invention relates to a drain trap clean-out system and more particularly pertains to preventing solids from entering wastewater lines and sewer gas backup while allowing liquid flow and convenient removal of solids.

2. Description of the Prior Art

The use of drain traps of known designs and configurations is known in the prior art. More specifically, drain traps of known designs and configurations previously devised and utilized for the purpose of trapping solids from wastewater lines are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,217,763 issued Feb. 27, 1917 to Hirrich relates to a drain pipe cleaner. U.S. Pat. No. 3,834,539 issued Sep. 10, 1974 to Thompson relates to a trap for removing solid particles from a liquid circulating system. U.S. Pat. No. 4,164,048 issued Aug. 14, 1979 to Kampfer relates to a combination sink trap access port filtration device. U.S. Pat. No. 4,949,682 issued Aug. 21, 1990 to Klein relates to a particulate and dirt collecting indicator, deflector and collector for an auto coolant system. U.S. Pat. No. 5,241,979 issued Sep. 7, 1993 to Chang relates to a structure of an elbow pipe. U.S. Pat. No. 5,267,361 issued Dec. 7, 1993 to Lai relates to a drain trap. Lastly, U.S. Pat. No. 6,307,350 issued Oct. 30, 2001 to Marchionda relates to a drain trap filter assembly.

While these devices fulfill their respective, particular objectives and requirements, the aforementioned patents do not describe a drain trap clean-out system that allows preventing solids from entering wastewater lines and sewer gas backup while allowing liquid flow and convenient removal of solids.

In this respect, the drain trap clean-out system according to the present invention substantially departs from the conventional concepts and designs of the prior art, and in doing so provides an apparatus primarily developed for the purpose of preventing solids from entering wastewater lines and sewer gas backup while allowing liquid flow and convenient removal of solids.

Therefore, it can be appreciated that there exists a continuing need for a new and improved drain trap clean-out system which can be used for preventing solids from entering wastewater lines and sewer gas backup while allowing liquid flow and convenient removal of solids. In this regard, the present invention, as illustrated in its embodiments, substantially fulfills this need.

SUMMARY OF THE INVENTION

In view of the foregoing disadvantages inherent in the known types of drain traps of known designs and configurations now present in the prior art, the present invention provides an improved drain trap clean-out system. As such, the general purpose of the present invention, which will be described subsequently in greater detail, is to provide a new and improved drain trap clean-out system and method which has all the advantages of the prior art and none of the disadvantages.

To attain this, the present invention attaches to a sink. The sink has a bottom opening. External male threads are provided around the bottom opening.

An interior pipe is provided next. The interior pipe has an upper end extending into the opening and couples to the bottom of the drain of the sink. The interior pipe has a lower end. A central extent is provided between the upper and lower ends. An upper jam nut is provided around the interior pipe adjacent to the upper end. Internal female threads are provided. The female threads are removably coupled to the external male threads of the sink. A gasket is provided between the upper jam nut and the sink. The interior pipe forms a compression fitting.

Provided next is an exterior pipe. The exterior pipe has an upper region. The upper region receives the central extent of the interior pipe. The exterior pipe has an enlarged lower region. The lower region forms a ledge and receives the lower extent of the interior pipe. The lower region terminates in internal female threads. The lower region has a plug. The plug has external male threads. The male threads removably couple the plug with the exterior pipe.

A T-shaped pipe is provided. The T-shaped pipe has an upper portion. The upper section is coupled with respect to the interior pipe. The T-shaped pipe has a lower portion. The lower portion is coupled with respect to the exterior pipe. The T-shaped pipe also has a central portion. The central section is adapted to be joined to a wastewater line. An adhesive is provided. The adhesive attaches the exterior of the upper region of the exterior pipe to the interior of the lower portion of the T-shaped pipe.

Provided next is a sleeve. The sleeve has an exterior surface. The exterior surface has external male threads. The sleeve has an interior surface. A reducer bushing is provided. The reducer bushing has an exterior surface. The exterior surface is threadedly attached to the interior surface of the T-shaped pipe at its upper portion. The interior surface is formed with internal female threads. The female threads adjustably are coupled to the external male threads of the sleeve. A lower jam nut is provided above the sleeve. The lower jam nut has internal female threads. The female threads are removably coupled to the male threads of the sleeve. A gasket is provided between the lower jam nut and the sleeve. The interior pipe forms a compression fitting between the lower jam nut and the sleeve.

Further provided is a primary screen. The primary screen is in a frusto-conical configuration. The primary screen has an enlarged lower end. The lower end is in contact with and supported by the plug. The primary screen has a smaller higher end. The higher end is lined up with and slightly below the lower end of the interior pipe.

Provided last is a secondary screen. The secondary screen is in an annular configuration. The secondary screen has an interior edge. The interior edge is in contact with the exterior surface of the interior pipe adjacent to the lower end. The secondary screen has an exterior edge. The exterior edge is in contact with the interior surface of the enlarged lower portion of the exterior pipe. The exterior pipe is in contact with the ledge. In this manner, water passing from the sink will flow downwardly through the interior pipe and upwardly through the space between the interior and exterior pipes passing through one or more screens, then laterally through the central portion of the T-shaped pipe.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drain trap clean-out system which has all of the advantages of the prior art drain traps of known designs and configurations and none of the disadvantages.

It is another object of the present invention to provide a new and improved drain trap clean-out system which may be easily and efficiently manufactured and marketed.

It is a further object of the present invention to provide a new and improved drain trap clean-out system which is of durable and reliable constructions.

An even further object of the present invention is to provide a new and improved drain trap clean-out system which is susceptible of a low cost of manufacture with regard to both materials and labor, and which accordingly is then susceptible of low prices of sale to the consuming public, thereby making such drain trap clean-out system economically available to the buying public.

Even still another object of the present invention is to provide a drain trap clean-out system for preventing solids from entering wastewater lines and sewer gas backup while allowing liquid flow and convenient removal of solids.

Lastly, it is an object of the present invention to provide a new and improved drain trap clean-out system. An interior pipe has an upper end, a lower end and a central extent. An exterior pipe has an upper region receiving the central extent of the interior pipe and a lower region receiving the lower extent of the interior pipe. The lower region terminates with a removably coupled plug. A T-shaped pipe has an upper, lower and central portion. The upper portion is coupled with respect to the interior pipe. The lower portion is coupled with respect to the exterior pipe. The central portion is adapted to be joined to a wastewater line. Water passing from the sink will flow downwardly through the interior pipe and upwardly through the space between the interior and exterior pipes passing through one or more screens, then laterally through the central portion of the T-shaped pipe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of the primary embodiment of a drain trap clean-out system constructed in accordance with the principles of the present invention.

FIG. 2 is an enlarged exploded front elevational view taken within circle 2 of FIG. 1.

The same reference numerals refer to the same parts throughout the various Figures.

DESCRIPTION OF THE PREFERRED EMBODIMENT

Figures 3, 4:
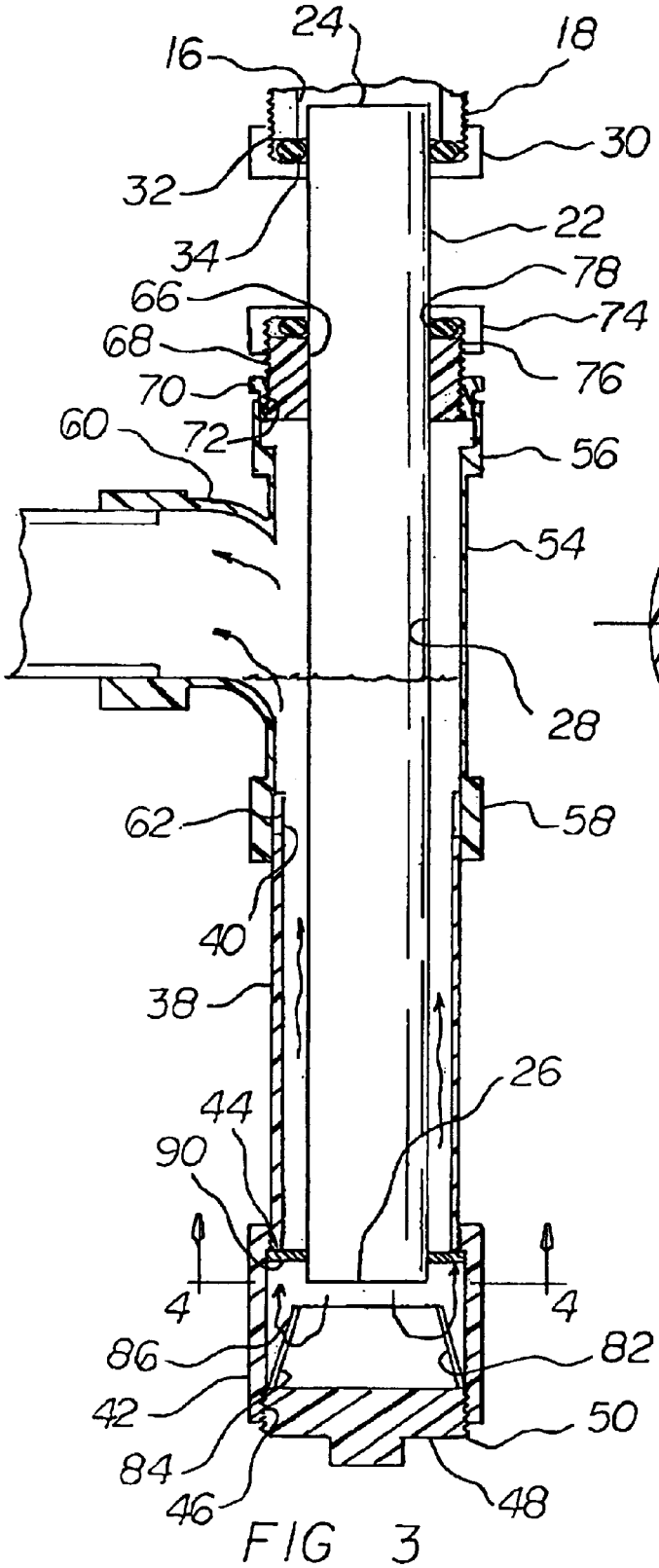
FIG. 3 is a cross sectional view taken along line 3—3 of FIG. 1.
FIG. 4 is a cross sectional view taken along line 4—4 of FIG. 3.
Figure 5:
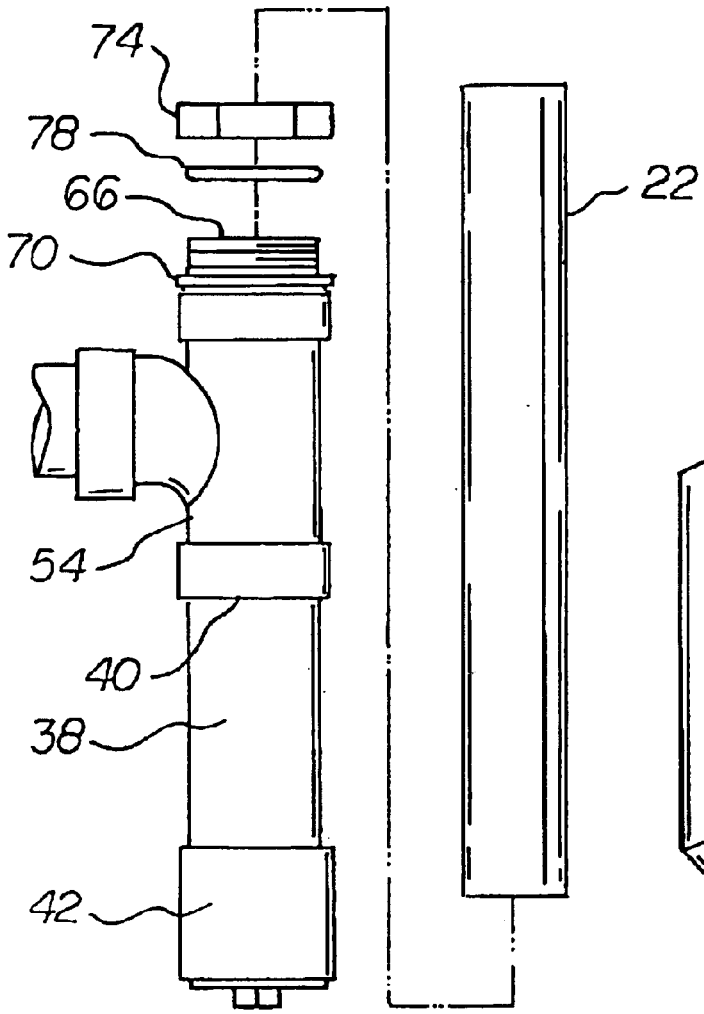
FIG. 5 is an exploded front elevational view of the system shown in FIGS. 1 and 3.

With reference now to the drawings, and in particular to FIG. 1 thereof, the preferred embodiment of the new and improved drain trap clean-out system embodying the principles and concepts of the present invention and generally designated by the reference numeral 10 will be described.

The present invention, the drain trap clean-out system 10 is comprised of a plurality of components. Such components in their broadest context include an interior pipe, an exterior pipe, a T-shaped pipe and at least one screen. Such components are individually configured and correlated with respect to each other so as to attain the desired objective.

First provided is a sink 14. The sink has a bottom opening 16. External male threads 18 are provided around the bottom opening.

An interior pipe 22 is provided next. The interior pipe has an upper end 24. The upper end attaches to the sink at the opening. The interior pipe has a lower end 26. A central extent 28 is provided between the upper and lower ends. An upper jam nut 30 is provided around the interior pipe adjacent to the upper end. Internal female threads 32 are provided. The female threads are removably coupled to the external male threads of the sink. A gasket 34 is provided between the upper jam nut and the sink. The interior pipe forms a compression fitting.

Provided next is an exterior pipe 38. The exterior pipe has an upper region 40. The upper region receives the central extent of the interior pipe. The exterior pipe has an enlarged lower region 42. The lower region forms a ledge 44 and receives the lower extent of the interior pipe. The lower region terminates in internal female threads 46. The lower region has a plug 48. The plug has external male threads 50. The male threads removably couple the plug with the exterior pipe. In an alternate embodiment of the invention, the lower region 42 may be coupled to the upper region 40. The coupling of the lower region 42 and upper region 40 being at 44. The upper and lower regions may be threadedly attached or coupled.

A T-shaped pipe 54 is provided. The T-shaped pipe has an upper portion 56. The upper section is coupled with respect to the interior pipe. The T-shaped pipe has a lower portion 58. The lower portion is coupled with respect to the exterior pipe. The T-shaped pipe also has a central portion 60. The central section is adapted to be joined to a wastewater line.

An adhesive 62 is provided. The adhesive attaches the exterior of the upper region of the exterior pipe to the interior of the lower portion of the T-shaped pipe.

Provided next is a sleeve 66. The sleeve has an exterior surface. The exterior surface has external male threads 68. The sleeve has an interior surface. A reducer bushing 70 is provided. The reducer bushing has an exterior surface. The exterior surface is adhesively attached to the interior surface of the T-shaped pipe at its upper portion. The interior surface is formed with internal female threads 72. The female threads adjustably are coupled to the external male threads of the sleeve. A lower jam nut 74 is provided above the sleeve. The lower jam nut has internal female threads 76. The female threads are removably coupled to the male threads of the sleeve. A gasket 78 is provided between the lower jam nut and the sleeve. The interior pipe forms a compression fitting between the lower jam nut and the sleeve.

Further provided is a primary screen 82. The primary screen is in a frusto-conical configuration. The primary screen has an enlarged lower end 84. The lower end is in contact with and supported by the plug. The primary screen has a smaller higher end 86. The higher end is lined up with and slightly below the lower end of the interior pipe.

Provided last is a secondary screen 90. The secondary screen is in an annular configuration. The secondary screen has an interior edge. The interior edge is in contact with the exterior surface of the interior pipe adjacent to the lower end. The secondary screen has an exterior edge. The exterior edge is in contact with the interior surface of the enlarged lower portion of the exterior pipe. The exterior pipe is in contact with the ledge. In this manner, water passing from the sink will flow downwardly through the interior pipe and upwardly through the space between the interior and exterior pipes passing through one or more screens, then laterally through the central portion of the T-shaped pipe.

Figure 6:
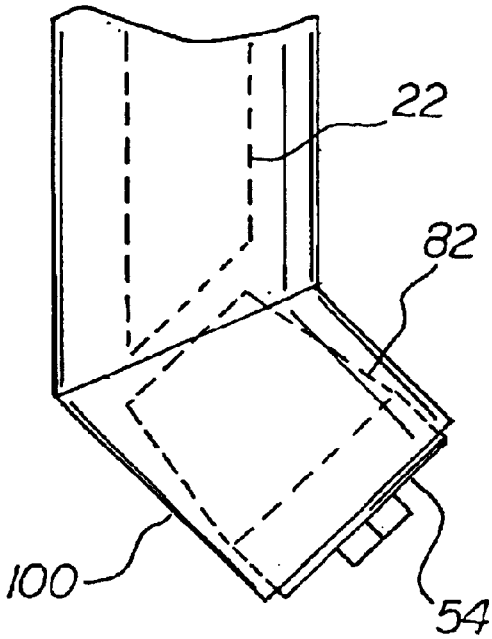
FIG. 6 is an enlarged front elevational view of the lower portion of a system constructed in accordance with an alternate embodiment of the invention.

In the present invention the interior pipe has a vertical central axis. The exterior pipe also has a vertical central axis. The vertical central axis of the exterior pipe is coextensive with the central axis of the interior pipe throughout their lengths. In an alternate embodiment of the invention, however, the lower portion 100 of the exterior pipe has an axis at an angle with respect to the axes of the interior and exterior pipes. The bottom of the interior pipe is preferably cut at an angle to provide a larger opening. All other components of the alternate embodiment are as in the primary embodiment of FIGS. 1 through 5. In this manner the removal of the plug is facilitated during the cleaning of the screens. Note the alternate embodiment of the invention as shown in FIG. 6.

In the present invention, the screens and their placement use gravity to help propel the water to backwash the screens. This backwash feature allows the user to clean the screens by simply opening the bottom plug. In addition, the screen functions to preclude the traveling of roaches and other insects from the drain line to the sink.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drain trap clean-out system for preventing solids from entering wastewater lines and sewer gas backup while allowing liquid flow and convenient removal of solids comprising, in combination:

a sink with a bottom opening and external male threads there around;

an interior pipe having an upper end extending upwardly through the opening and a lower end and a central extent there between with an upper jam nut around the interior pipe adjacent to the upper end and internal female threads removably coupled to the external male threads of the sink and with a gasket between the upper jam nut and the sink and the interior pipe forming a compression fitting there between;

an exterior pipe having an upper region receiving the central extent of the interior pipe and an enlarged lower region forming a ledge and receiving the lower end of the interior pipe, the lower region terminating in internal female threads with a plug having external male threads for removably coupling the plug with the exterior pipe;

a T-shaped pipe having an upper portion coupled with respect to the interior pipe and a lower portion coupled with respect to the exterior pipe and a central portion adapted to be joined to a wastewater line, an adhesive attaching the exterior of the upper region of the exterior pipe to the interior of the lower portion of the T-shaped pipe;

a sleeve having an exterior surface with external male threads being adjacent to the upper portion of the T-shaped pipe, a reducer bushing having an exterior surface adhesively attached to the interior surface of the T-shaped pipe at its upper portion and an exterior surface formed with internal female threads adjustably coupled to the external male threads of the sleeve, a lower jam nut above the sleeve with internal female threads removably coupled to the male threads of the sleeve and with a gasket between the lower jam nut and the sleeve and the interior pipe forming a compression fitting there between;

a primary screen in a frusto-conical configuration with an enlarged lower end in contact with and supported by the plug and a smaller higher end lined up with and slightly below the lower end of the interior pipe; and a secondary screen in an annular configuration with an interior edge in contact with the exterior surface of the interior pipe adjacent to the lower end and with an exterior edge in contact with the interior surface of the enlarged lower portion of the exterior pipe in contact with the ledge whereby water passing from the sink will flow downwardly through the interior pipe and upwardly through the space between the interior and exterior pipes passing through one or more screens, then laterally through the central portion of the T-shaped pipe.

2. A drain trap clean-out system comprising:

an interior pipe having an upper end and a lower end and a central extent;

an exterior pipe having an upper region receiving the central extent of the interior pipe and a lower region receiving the lower end of the interior pipe, the lower region terminating with a removably coupled plug;

a T-shaped pipe having an upper portion coupled with respect to the interior pipe and a lower portion coupled with respect to the exterior pipe and a central portion adapted to be joined to a wastewater line; and at least one screen adjacent to the plug whereby, water passing from the sink will flow downwardly through the interior pipe and upwardly through the space between the interior and exterior pipes passing through one or more screens, then laterally through the central portion of the T-shaped pipe.

3. The system as set forth in claim 2 and further including an upper compression fitting coupling the upper end of the interior pipe to a sink.

4. The system as set forth in claim 2 and further including a lower compression fitting coupling the upper end of the T-shaped pipe to the interior pipe.

5. The system as set forth in claim 2 wherein the screen includes a frusto-conical screen.

6. The system as set forth in claim 2 wherein the screen includes a screen in an annular configuration.

7. The system as set forth in claim 2 wherein the interior pipe has a vertical central axis and the exterior pipe has a vertical central axis coextensive with the central axis of the interior pipe with the lower portion of the exterior pipe having an axis at an acute angle with respect to the axes of the interior and exterior pipes to facilitate the removal of the plug during the cleaning of the screens.

* * * * *